US006094947A

United States Patent [19]

Scatizzi

[11] Patent Number: 6,094,947

[45] Date of Patent: Aug. 1, 2000

[54] AUTOMATIC APPARATUS FOR DYEING TEXTILE MATERIALS

[75] Inventor: Mario Scatizzi, Pistoia, Italy

[73] Assignee: Tecnorama S.r.l., Italy

[21] Appl. No.: 09/107,554

[22] Filed: Jun. 29, 1998

[30] Foreign Application Priority Data

Aug. 14, 1997 [IT] Italy ..... FI97A0199

[51] Int. Cl.[7] ..... D06B 5/08

[52] U.S. Cl. ..... 68/27; 68/148; 68/156; 68/165; 68/170; 68/207; 68/210

[58] Field of Search ..... 68/27, 207, 210, 68/148, 156, 165, 170

[56] References Cited

U.S. PATENT DOCUMENTS

| | | | |
|---|---|---|---|
| 205,272 | 6/1878 | Hysore | 68/210 |
| 452,040 | 5/1891 | Mason, Jr. et al. | 68/210 X |
| 2,000,745 | 5/1935 | Demol | 68/27 |
| 2,901,902 | 9/1959 | Horsfall | 68/170 |
| 3,126,725 | 3/1964 | Parker et al. | 68/27 |
| 3,323,337 | 6/1967 | Graziano | 68/27 |
| 3,344,622 | 10/1967 | Kronsbein | 68/210 X |
| 3,379,038 | 4/1968 | Blancafort | 68/170 X |
| 5,400,453 | 3/1995 | Hamann | 68/27 X |
| 5,755,119 | 5/1998 | Scatizzi | 68/170 X |

FOREIGN PATENT DOCUMENTS

| | | | |
|---|---|---|---|
| 0288373 | 10/1988 | European Pat. Off. | 68/210 |
| 18349 | 5/1985 | Japan | 68/207 |
| 460343 | 9/1975 | U.S.S.R. | 68/210 |
| 765432 | 9/1980 | U.S.S.R. | 68/210 |

*Primary Examiner*—Philip R. Coe
*Attorney, Agent, or Firm*—McGlew & Tuttle, PC

[57] ABSTRACT

An apparatus for dyeing textile materials is provided that includes one or more chambers for dyeing and one or more storage baskets. The apparatus has a first station with a container hydraulically connected with the chamber. The first station is for the drawing and metering of dyeing solutions and for the admission of the dyeing solutions into the container to feed the chamber for dyeing the material disposed inside the storage basket. A second station has a stirrer. The basket is connected in a stable but removable way to the stirrer. The basket is located in correspondence with the chamber.

7 Claims, 10 Drawing Sheets

AUTOMATIC APPARATUS FOR DYEING TEXTILE MATERIALS

FIELD OF THE INVENTION

The present invention refers to an automatic apparatus for dyeing textile materials, especially for laboratory use.

BACKGROUND OF THE INVENTION

It is known, in the dyeing of textile materials, that the materials fibres must be subjected to the action of suitable dyes diluted in a dyeing bath at a temperature and for a time to be preset according to the nature of the same fibers and the type of dyes used.

One of the problems mostly felt in this industrial sector is the repeatability of the dyeing processes in relation to laboratory tests which are carried out for the preparation and verification of the formulations or "recipes". The dyeing performed during the industrial production stage, without a proper preventive laboratory check, may actually imply the need of correcting the formulation of the bath intended to feed the dyeing machines, which brings about extra costs, production delays, possible unevenness of the bath and consequent lower quality of the finished product.

SUMMARY AND OBJECTS OF THE INVENTION

The main object of the present invention is to provide an automatic apparatus, especially for laboratory use, for the preparation and verification of the recipes, which is able to facilitate the standardization of the dyeing processes, to increase their reliability to a significant degree and simulate as accurately as possible the operating conditions of the dyeing process performed by means of industrial machines.

An apparatus according to the present invention is relatively simple to make, cost-effective and reliable even after a prolonged service life. Besides, it makes it possible to fully automate the preparation and verification of the recipes on samples of textile materials and to achieve the highest degree of repeatability of the experimental dyeing processes so as to ensure the most correct, efficient and uniform industrial dyeing of the same materials. This also allows reducing the running costs of the dyeing plants.

BRIEF DESCRIPTION OF THE INVENTION

These and other advantages and characteristics of the invention will be best understood by anyone skilled in the art from a reading of the following description in conjunction with the attached drawings given as a practical exemplification of the invention, but not to be considered in a limitative sense, wherein:

FIGS. 5A–5C show a view in longitudinal section view, a bottom view and an exploded view of a basket for textile materials in form of reels of yarn, fabrics, and the like.

DESCRIPTION OF THE PREFERRED EMBODIMENT

Figure 1A:
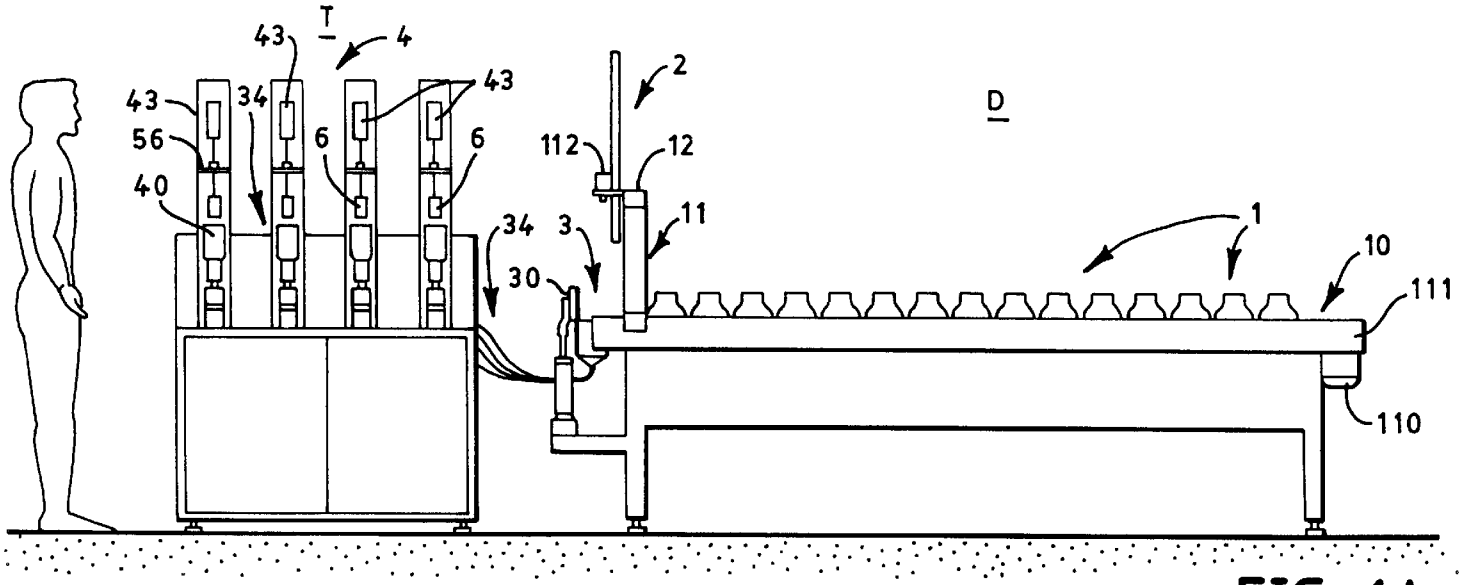
FIGS. 1A and 1B show schematically a side view and a plan view of an apparatus according to the invention.

Reduced to its basic structure, and reference being made to the figures of the attached drawings, an apparatus according to the invention comprises:

- a first station (D) for storing a plurality of vessels (1) holding a plurality of dyeing solutions;
- means (2), located in correspondence of said first station (D), for the removal of the solutions from the vessels (1) in a predeterined amount and according to a programmed sequence of removal: said means (2) also providing for drawing the thus removed liquid dyes into stand-by containers (3) located downstream of the first station (D);
- means, in a second station (T) located downstream of the first one (D), with a plurality of dyeing units (4) each of which is connected to a corresponding container (3) of the set of dyes, that is, the whole of containers (3) in which the solutions removed from the vessels (1) located in the first station (D) are stored.

Figure 1B:
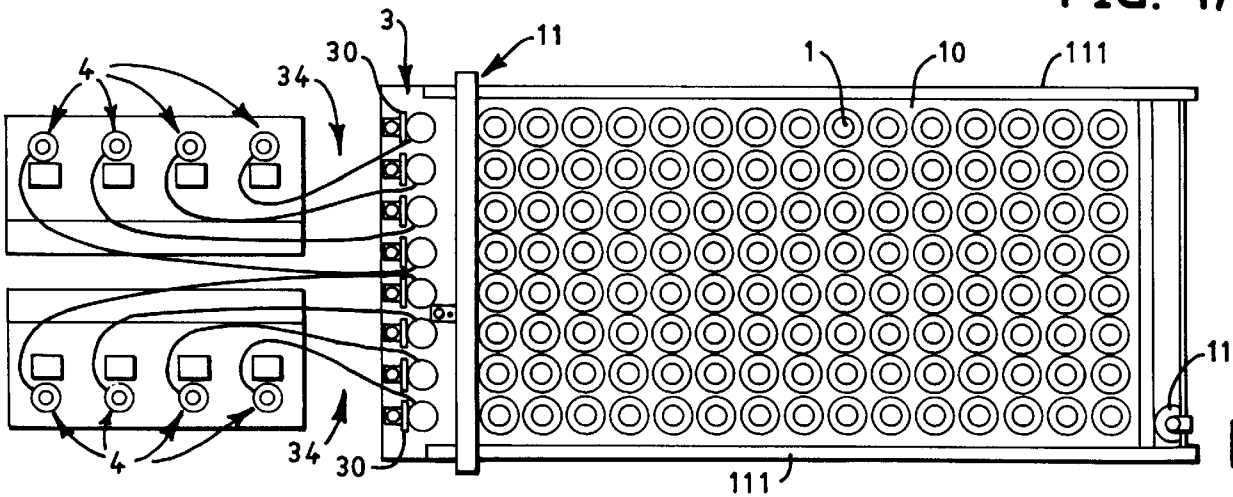
Figure 2C:
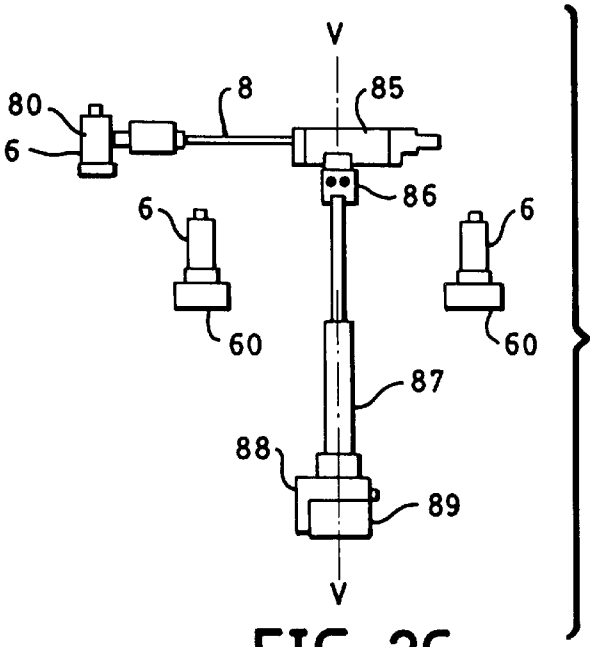
FIGS. 2A–2C show schematically the means for moving the materials-holding baskets between the dyeing device and the baskets-storing station, in which said baskets are in a condition ready for their removal from, respectively, delivery to the dyeing device.
Figure 2A:
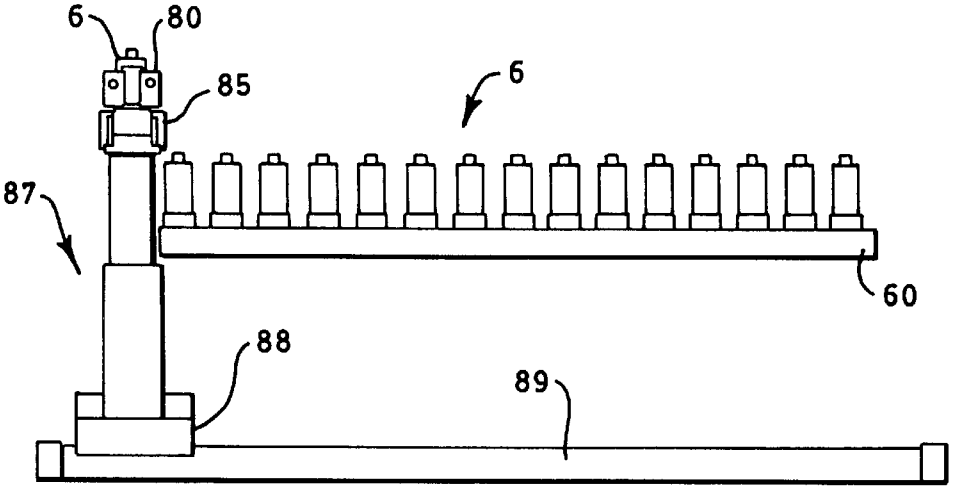
Figure 2B:
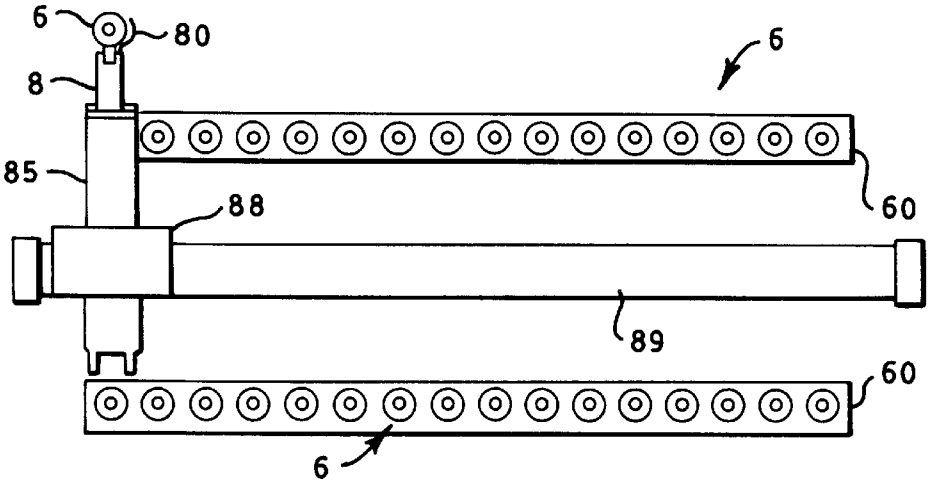
Figure 2F:
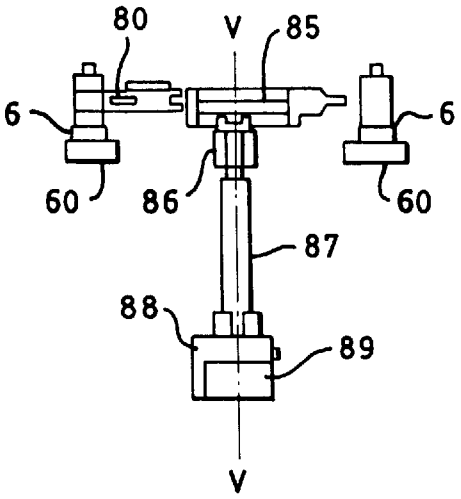
FIGS. 2D–2F show schematically the means for moving the materials-holding baskets between the dyeing device and the baskets-storing station, in which said baskets are in a condition ready for their removal from, respectively, delivery to the support of the storing station.
Figure 2D:
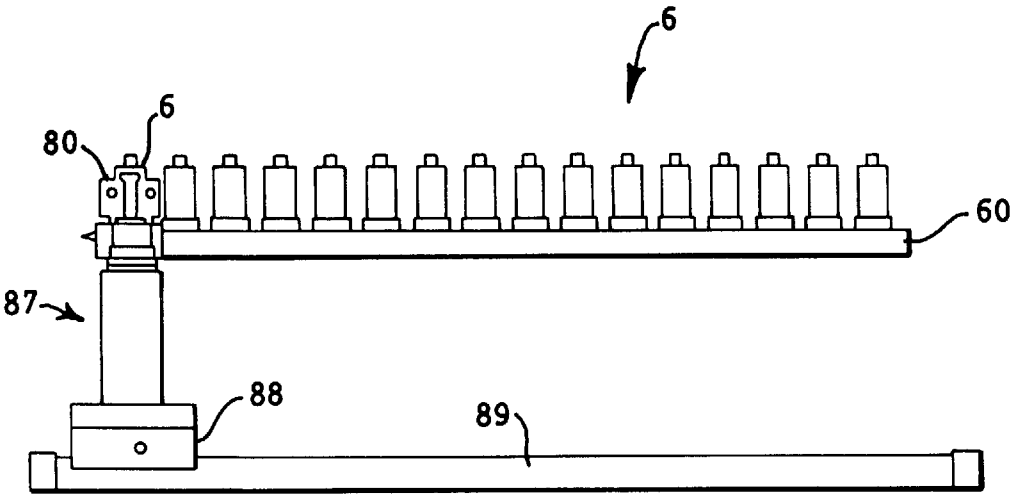
Figure 2E:
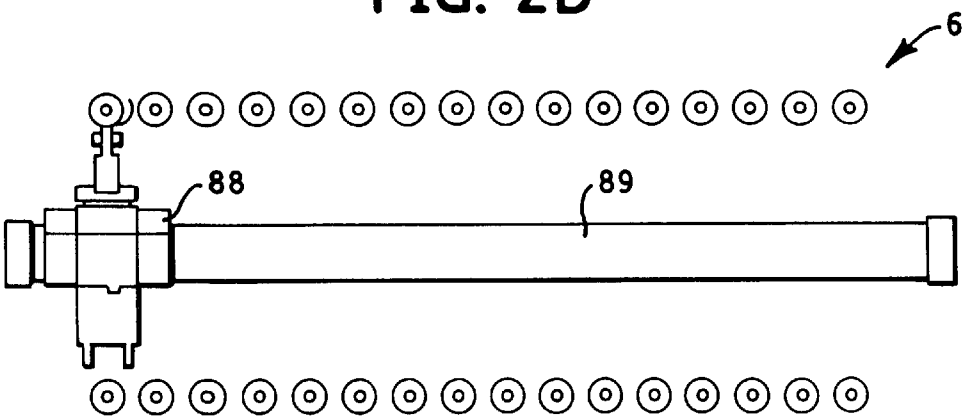
Figure 2I:
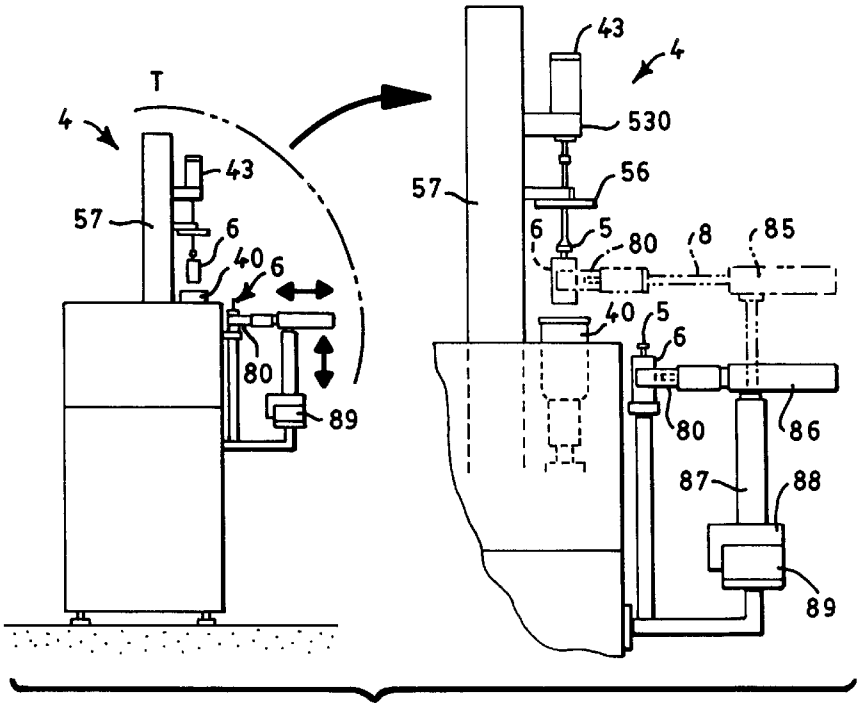
FIGS. 2G, 2H and 2L are respectively an elevation view, a plan view and side view of the station with the dyeing units, which show the means for the removal and storage of the baskets holding the materials to be treated.
Figure 2G:
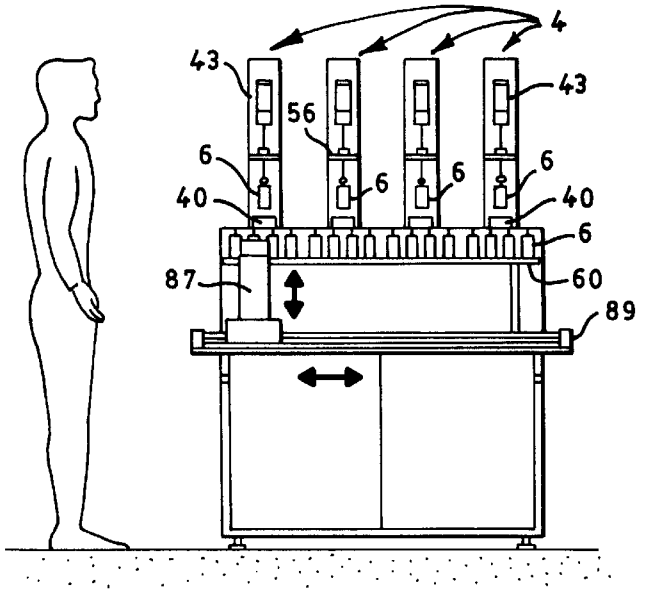
Figure 2H:
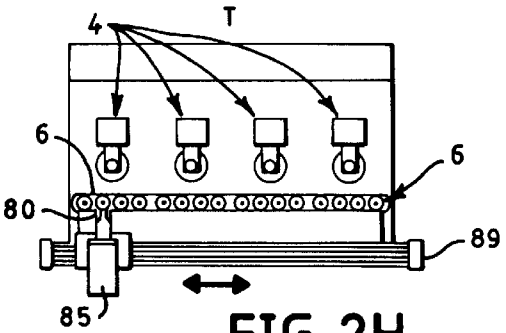

AS illustrated in the FIGS. 1A and 1B of the attached drawings, the vessels (1) of the first station (D) can be positioned over a horizontal plane (10) on which a carriage (11) is mounted movable along the longitudinal axis of the plane (10), that is, on side straight guides (111) of the latter, under control of an electric motor (110) and with a cross-piece (12) oriented transversally to said axis, the means (2) being mounted on the cross-piece (12) of said carriage (11) for the removal of solutions from the vessels (1). The said means for the removal of the solutions are of a type comprising a pipette movable from and to the vessels (1). The construction and operation of the pipette are known to those skilled in the art and, therefore, will not be described herein in further details. For the removal of the solutions from the preselected vessels (1), the pipette (2) is moved by the carriage (11) to result in correspondence of said vessels, with the aid of a positioning system which comprises, for example, a plurality of encoders associated, respectively, to the motor (110), to a motor (112) which drives into motion the pipette (2) along the cross-piece (12) of carriage (11) and to a third motor, not shown, for moving the pipette (2) vertically. The pipette (2) results thus movable in the three spatial orthogonal directions between the station (D), the containers (3) downstream of the platform (10) and a washing station, not shown in the figures of the attached drawings, in which provision is made for at least a vessel for holding water or other liquid for cleaning the pipette (2).

Each of the containers (3) downstream of the platform (10) is advantageously connected to the respective dyeing unit .(4) via a corresponding conduit (34) through which the dyeing solution is transferred from the container (3) to the dyeing chamber (40) corresponding to the unit (4). The transfer is assisted by the admission of compressed air into the container (3) being used each time. The compressed air is introduced into the container (3) after closing a tight seal cover (30) located above and operable by an actuator (31) mounted on the fixed structure (300) which supports the containers (3), said actuator acting on an arm (310) which connects the rod thereof to the cover (30), said arm being connected to the same container (3) by a hinge member (311) having horizontal axis. Two holes formed in the cover (30) of the container (3) allow the positioning of a flexible conduit (33) for the admission of compressed air, and of a flexible conduit (330) for the admission of water or other cleaning liquid into the container (3).

Each of said dyeing units (4) comprises means for vertically reciprocating a basket (6) inside the dyeing chamber (40), the materials to be treated being introduced into the basket (6) by means of an actuator cylinder (43) having vertical axis and whose rod (42) is removably connected to the upper portion of the basket (6) . To this end, the upper side of the basket (6) may be advantageously provided with an appendix (5) intended to come in contact with the corresponding cavity (50) of a flange (55) fixed to the lower end of the rod (42) of cylinder (43). In this way, each basket (6) as a result will be easily and rapidly connectable with a relevant stirring cylinder (43), with no need for screws, bolts or similar fastening elements, the connection being possibly made either manually or automatically as described later on.

Figure 3A:
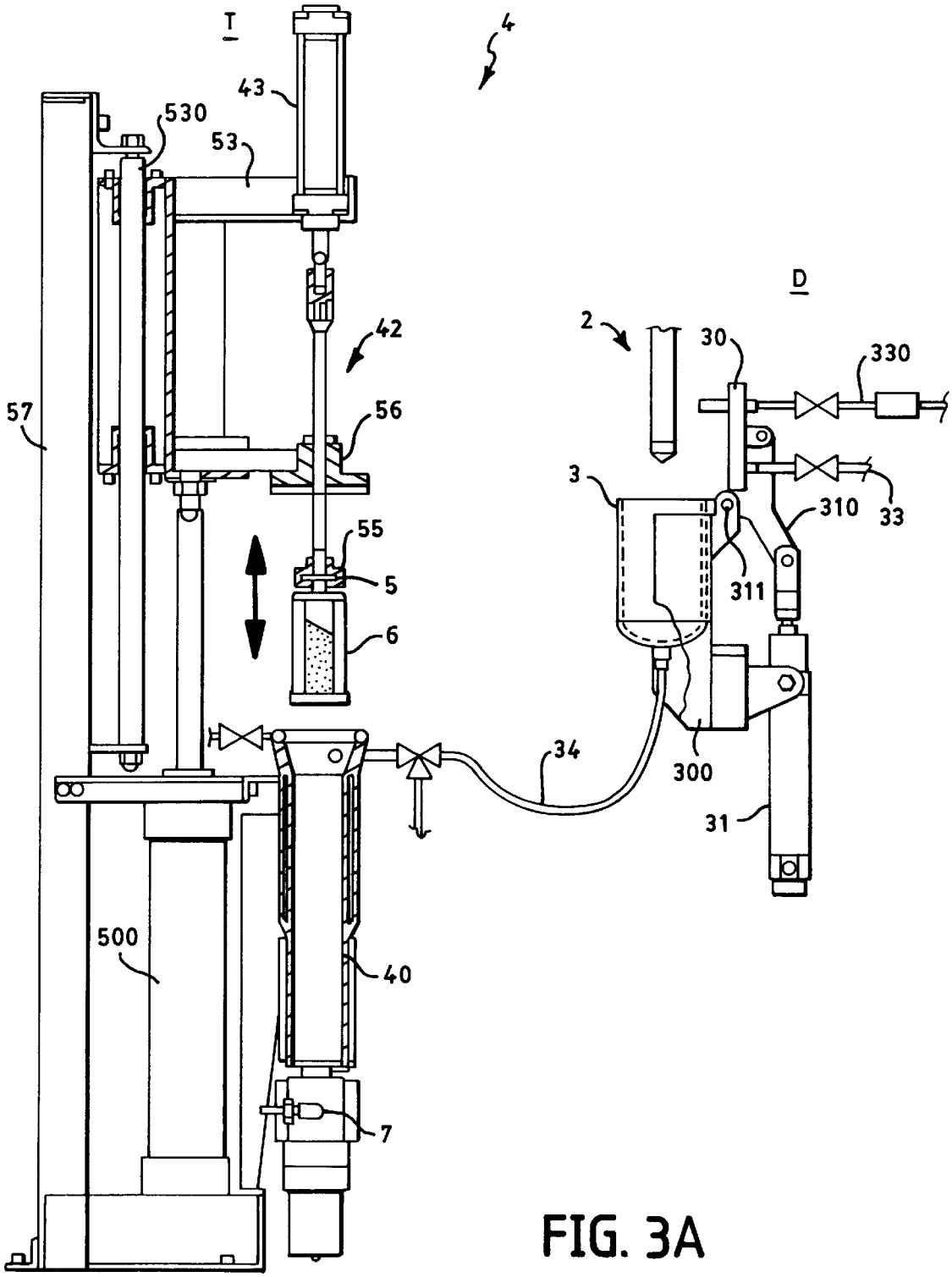
FIGS. 3A and 3B show in detail the connection between the metering device and the dyeing device, with a basket outside, respectively, inside the container holding the dyeing solution.
Figure 3B:
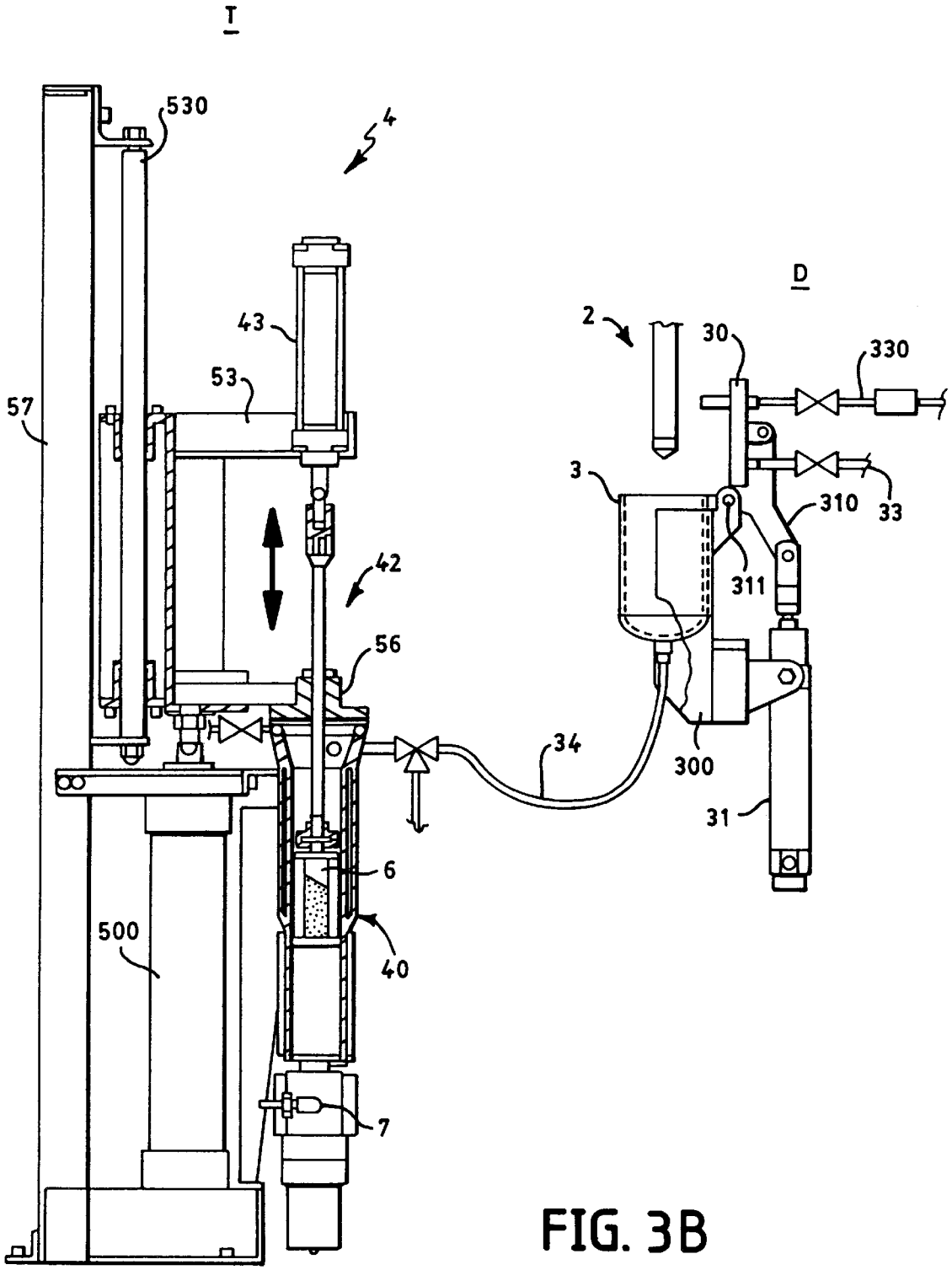
Figure 3C:
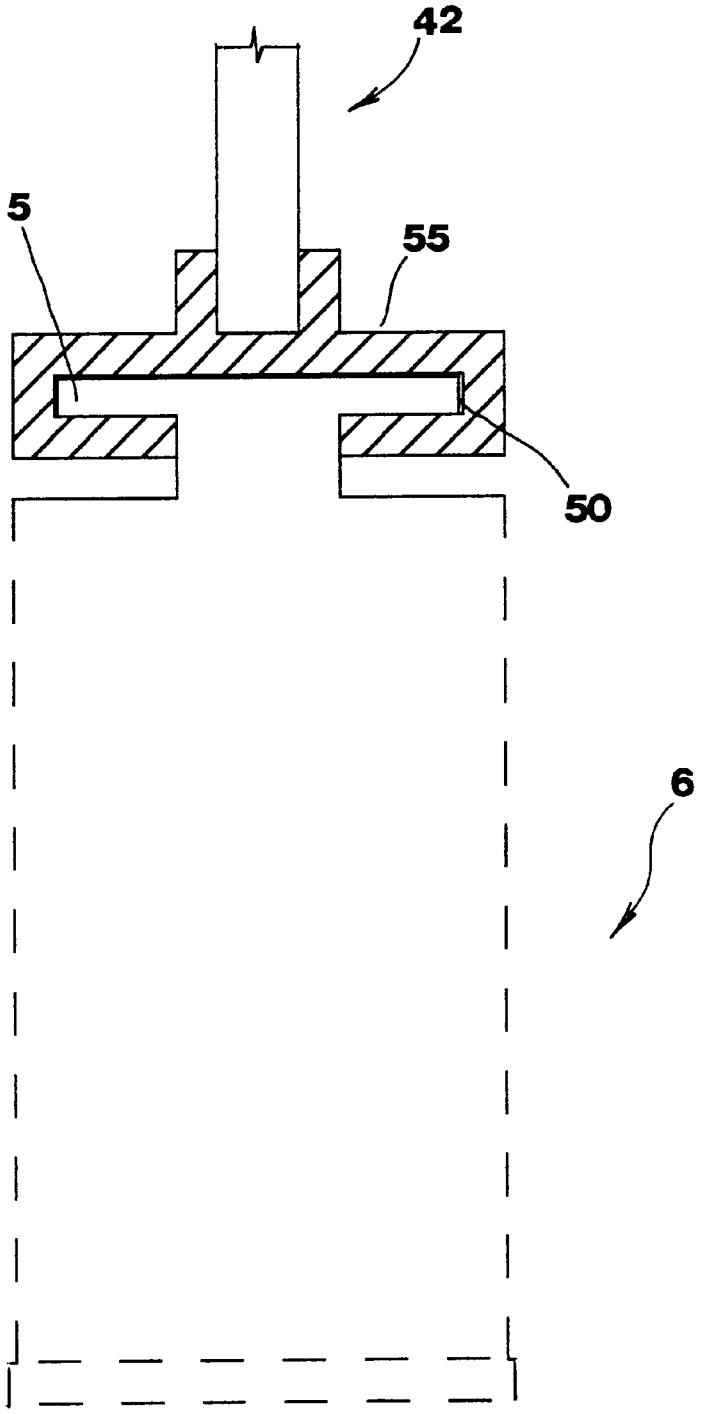
FIG. 3C shows in detail the connection between the basket and the respective stirring cylinder within a dyeing unit.

Each stirring cylinder (43) is suitably mounted on a support (53) moving onto a vertical straight guide (530) under control of an operating cylinder (500), so as to allow the positioning thereof at such a height that the corresponding basket (6) will be outside the dyeing chamber (40), as illustrated in FIG. 3A and, respectively, at a height allowing the same basket (6) to dip into the dyeing liquid of the chamber (40), as illustrated in FIG. 3B.

Also fixed to the said support (53), at a position below the fastening point of the stirring cylinder (43), is a body (56) which is provided with an underlying annular gasket acting as a tight-seal element for the corresponding dyeing chamber (40) when the basket (6) is dipped into the bath of the latter, the said body (56) being provided with a through hole and central gasket to allow the rod of the stirring cylinder (43) to move therethrough (see FIG. 3B).

Provided in a position below each one of said dyeing chambers (40) is a conduit (7) for the evacuation of the bath. Indicated by numeral (57) of FIGS. 3A and 3B is a fixed structure to which the cylinder (500) and the straight guide (530) are fastened.

As far as the means for the automatic positioning of the baskets (6) in correspondence of the dyeing units (4) are concerned, they comprise, according to a feasible embodiment, a horizontal arm (8) able to be moved horizontally, vertically and to be rotated about a vertical axis (v—v), said arm being provided, in correspondence of a free end thereof, with clamp means (80) whose jaws are intended to clamp on the external side wall of the baskets (6) upon the removal and the handling thereof, and to open up for their release.

As schematically illustrated in FIGS. 2A–2L of the attached drawings, the said arm (8) is formed by the rod of a pneumatic cylinder (85) having horizontal axis and mounted on a support (86) which is in turn supported by the rod of an underlying pneumatic cylinder (87) having vertical axis. The said support (86) is rotatively anchored to the rod of the vertical cylinder (87) and associated to a relevant driving member not shown in the figures of the attached drawings.

Moreover, advantageously, the vertical cylinder (87) of the means for positioning the baskets (6) in correspondence of the units (4) is mounted on a motor-driven carriage (88) sliding under control onto a horizontal guide (89) located in proximity of the units (4) and developing parallel to them. Owing to the thus ensured handling capability of the arm (8), it is possible to pick up the baskets (6) from one or more shelves (60) on which they are positioned awaiting to reach the destination units (4), to deliver them to the respective units (4) and to remove them therefrom at the end of the cycle for dyeing the materials held therein and lying them back in the respective initial positions.

In case only one shelf (60) is used for the baskets (6), there is no need of rotating the arm (8) and, accordingly, the horizontal cylinder (85) may be fixed to the vertical cylinder (87) without the connection member (86) being associated to any driving member.

Figure 4A:
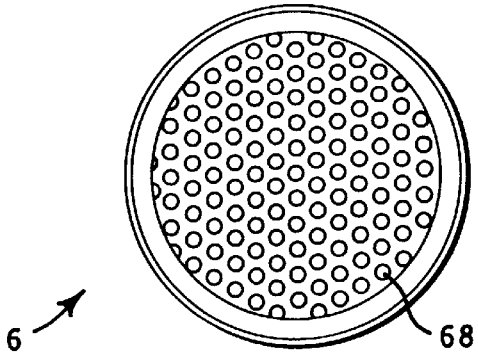
FIGS. 4A–4C shows a plan view, a longitudinal view partly in section and a bottom view of a basket for textile materials in form of hanks of yarn.
Figure 4B:
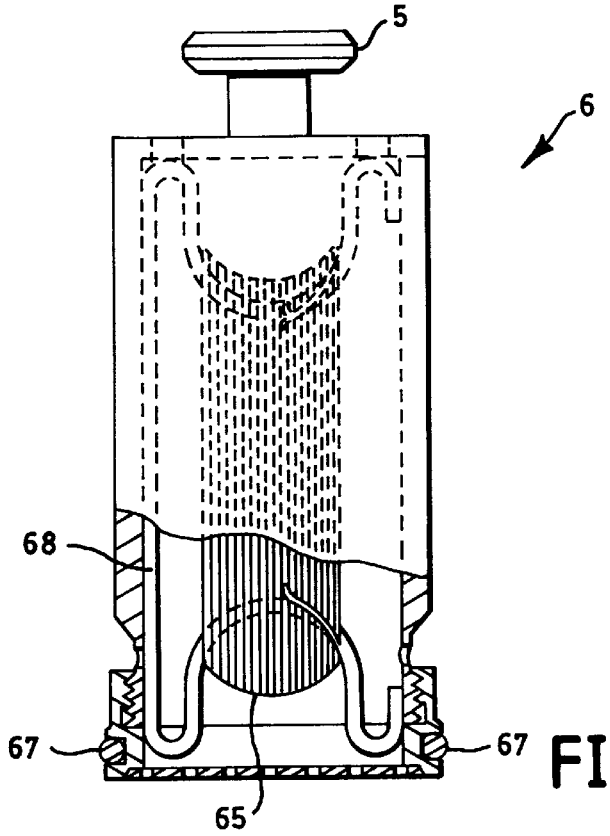
Figure 4C:
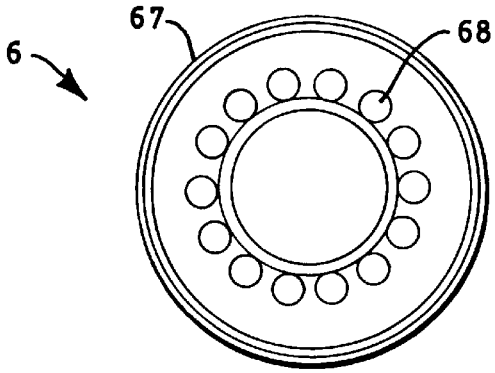

The baskets (6) may hold textile materials in hanks of yarn, as illustrated in FIGS. 4A–4C, where (65) indicates a hank of yarn wound up on a supporting core (66) able to be positioned within the cavity of the basket (6) whose upper and lower sides are provided with holes (68) for the circulation of the bath through the fibers of the yarn (65) when the basket (6) is driven by the respective stirring cylinder (43), an annular gasket (67) being associated to said lower side to ensure a tight seal against the inner wall of the dyeing chamber (40) to which the basket (6) is to be moved.

Figure 5A:
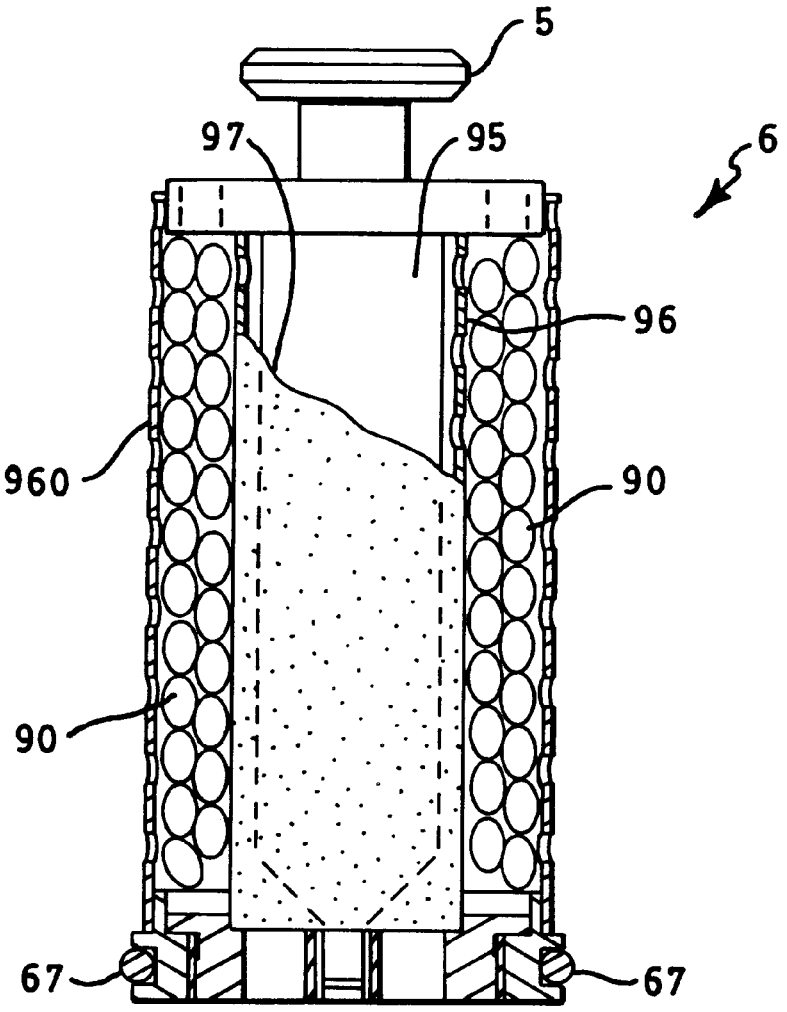
Figure 5B:
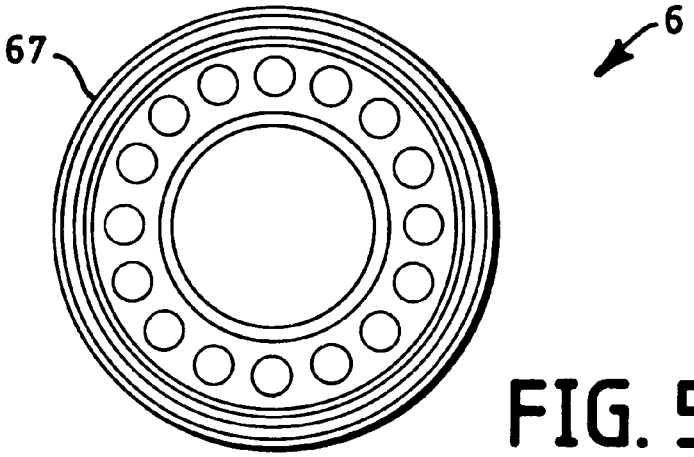
Figure 5C:
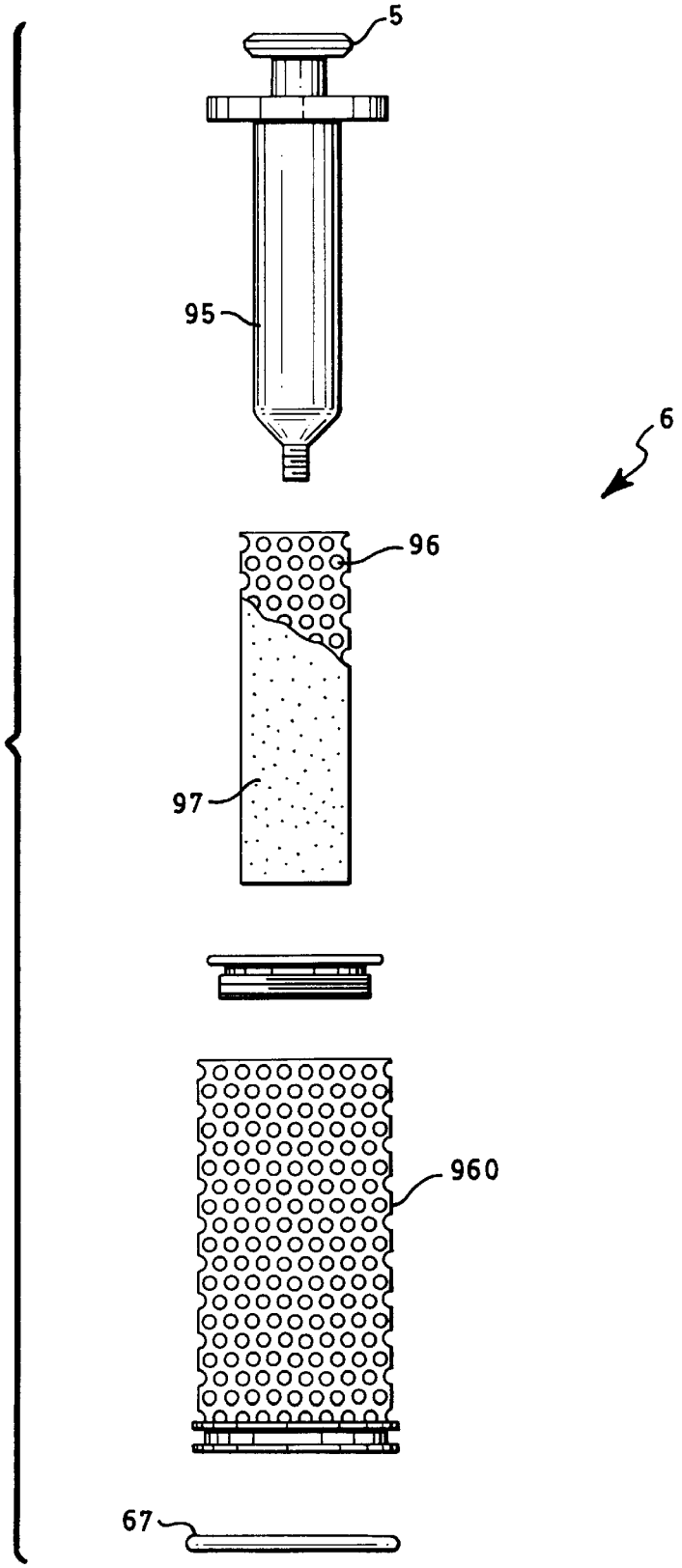

The baskets (6) may also contain textile materials (90) in different form, as illustrated in FIG. 5A, or in another form. The baskets (6) intended for textile materials in form of reels of yarn, fabrics and the like, have a central vertical core (95) with frusto-conical end, around which core are located a first and a second cylindrical grids (96, 960) of different diameter, coaxial to each other and with a close-mesh net (97) placed against the grid (96) of minor diameter (see FIGS. 5A–5C). The upper and lower sides of the basket (6) are suitably drilled and the lower side is provided with an annular gasket (67) likewise the previous case. The net (97) prevents the material under treatment from flowing through the holes of the first grid (96) which, in cooperation with the central core (95), delimits a chamber of annular cross-section through which the liquid of the dyeing bath can freely circulate for a more uniform and efficient dyeing of the material under treatment.

The operation of the above described apparatus is as follows.

According to the preset work program, the pipette (2) draws the liquids, in preset sequence and doses, from the vessels (1) located on the platform (10) into the respective containers (3). Firstly, for the transfer of the liquids from the containers (3) to the target chambers (40), the covers (30) are made to rotate in a direction which allows closing the containers (3) and, afterwards, compressed air is drawn into the same containers to force the liquids therein to flow through the respective conduits (34). The water for cleaning the containers (3) is likewise transferred to the respective dyeing chambers (40) in a quantity measured by a volumetric meter until the preset volume of the bath inside the chambers (40) is reached. At the same time, or subsequently as well, the arm (8) with clamps (80) provides for picking up the baskets (6) loaded with material to be treated, in a sequence preset by the program, to hand them over to the respective stirring cylinder (43) disposed so as to have the baskets (6) lifted up, that is, moved outside the chambers (40) wherein the liquid is admitted from the containers (3). Each basket (6) thus positioned is then dipped down into the respective dyeing chamber (40) by the cylinder (500) which commands the lowering of the structure (53) supporting the respective stirring cylinder (43), thereby operating, at the same time, the closing of the chamber (40) by means of the element (56). At this point, the stirring cylinder (43) of each basket (6) thus positioned is operated for a time preset according to the specific dyeing cycle to be performed, thereby circulating the bath across the fibers of the textile material from the inside to the outside of basket (6); each basket (6) acting as the plunger of a pump. At the end of this cycle, each basket is withdrawn from the respective dyeing chamber (40) under control of the respective cylinder (500), and picked up by the arm (8) that puts it down in a stand-by position outside the dyeing station (T). It will be appreciated that in the course of the dyeing of materials held in each basket (6), the drawing and the metering of the liquids held in the vessels (1) can be operated at any time, as the cycles for dyeing, drawing and metering are independent from each other.

For the control of the operating stages above described, electronic programmable means are used whose modes of operation are already known to those skilled in the industrial automation.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. An apparatus for dyeing textile materials comprising:

a chamber for dyeing;

a storage basket;

a first station with a container hydraulically connected with said chamber, said first station for the drawing and metering of dyeing solutions and for the admission of the dyeing solutions into said container to feed said chamber for dyeing the material disposed inside said storage basket;

a second station with a stirrer, said basket being connected in a stable but removable way to said stirrer and being located in correspondence with said chamber.

2. The apparatus according to claim 1, further comprising compressed air feeders, wherein a plurality of containers are provided and a plurality of chambers are provided, each of said containers being connected with a corresponding one of said chambers, each of said containers being associated with one of said compressed air feeders to facilitate the transfer of dyeing liquids to the respective dyeing chambers of said second station.

3. The apparatus according to claim 1, wherein said stirrer includes a cylinder with a horizontal axis, located above the corresponding dyeing chamber in said second station, and an upper part of each basket is removably connected to a lower end of a rod of said cylinder.

4. The apparatus according to claim 3, wherein an upper side of said basket is provided with an appendix, which comes in contact with a corresponding cavity of a flange fixed to a lower end of said rod of said stirring cylinder.

5. The apparatus according to claim 1, wherein said chamber at said second station is part of a dyeing unit and further comprising an automatic positioner for positioning said basket in correspondence to said dyeing unit of the second station, said automatic positioner having an arm with a free end having a clamp secured thereto, said clamp having jaws for clamping on an external side wall of said basket upon the removal and the handling thereof, and to open up for release of said basket, said arm being movable at least horizontally from and to said stirrer and parallel thereto.

6. The apparatus according to claim 5, wherein said arm includes a rod of a pneumatic cylinder having a horizontal axis and mounted on a support which is in turn supported by a rod of an underlying vertical axis pneumatic cylinder having a vertical axis, said vertical axis cylinder being mounted on a motor-driven carriage sliding, under control, onto a horizontal guide located in proximity of the dyeing unit and moveable parallel to them.

7. The apparatus according to claim 6, wherein said support is rotatively anchored to said rod of the vertical cylinder and associated to a relevant driving member.

* * * * *